US005205440A

United States Patent [19]

Matsushita

[11] Patent Number: 5,205,440

[45] Date of Patent: Apr. 27, 1993

[54] DISPENSING VALVE/COUPLING ASSEMBLY

[75] Inventor: Kaoru Matsushita, Tokyo, Japan

[73] Assignee: Nitto Kohki Co., Ltd., Tokyo, Japan

[21] Appl. No.: 879,465

[22] Filed: May 4, 1992

Related U.S. Application Data

[63] Continuation of Ser. No. 604,165, Oct. 29, 1990, abandoned.

[30] Foreign Application Priority Data

Nov. 2, 1989 [JP] Japan ..... 1-128894[U]
Jan. 10, 1990 [JP] Japan ..... 2-1440[U]

[51] Int. Cl.[5] ..... B67D 5/00

[52] U.S. Cl. ..... 222/83; 222/95; 222/496

[58] Field of Search ..... 222/81, 83, 83.5, 88, 222/89, 90, 95, 96, 106, 496, 571, 105

[56] References Cited

U.S. PATENT DOCUMENTS

| | | | |
|---|---|---|---|
| 2,258,636 | 10/1941 | Young et al. | 222/83.5 |
| 3,827,601 | 8/1974 | Magrath et al. | 222/83 |
| 4,168,018 | 9/1979 | Zahaykevich | 222/95 |
| 4,214,675 | 7/1980 | Schmit | 222/83 |
| 4,257,535 | 3/1981 | Mellet | 222/83 |
| 4,341,328 | 7/1982 | Redick, Jr. | 222/83.5 |
| 4,394,945 | 7/1983 | Taylor, Jr. | 222/571 |
| 4,765,511 | 8/1988 | Clements | 222/83 |
| 4,898,293 | 2/1990 | Morel | 222/83 |
| 4,948,014 | 8/1990 | Rutter et al. | 222/83 |
| 5,102,010 | 4/1992 | Osgar et al. | 222/105 X |

FOREIGN PATENT DOCUMENTS

| | | | |
|---|---|---|---|
| 0276994 | 8/1988 | European Pat. Off. | 222/105 |
| 3533241 | 5/1987 | Fed. Rep. of Germany | 222/105 |
| 62-258288 | 11/1987 | Japan | 222/83 |
| 0118797 | 5/1990 | Japan | 222/83 |
| 1406028 | 6/1988 | U.S.S.R. | 222/105 |
| 2077243 | 12/1981 | United Kingdom | 222/81 |
| 2165531 | 4/1986 | United Kingdom | 222/81 |

*Primary Examiner*—Andres Kashnikow
*Assistant Examiner*—Kenneth Bomberg
*Attorney, Agent, or Firm*—Nixon & Vanderhye

[57] ABSTRACT

A coupling of the present invention can be freely detachably attached to a flexible container whose outlet or opening is closed by a seal member broken by the tip of a male connector portion of the coupling. This coupling comprises a cylindrical body having at the tip thereof a hole for sucking fluid in the container, a valve seat formed in the cylindrical body, a valve body arranged in a fluid passing path communicated with the fluid sucking hole, and a spring for urging the valve body against the valve seat. When this coupling is attached to the opening of the container, the seal member by which the opening of the container is closed is broken by the tip of the cylindrical body. When a sucking pump is made operative to suck fluid in the container, therefore, the valve body is drawn against the spring to communicate the fluid passing path with the sucking hole, so that fluid in the container can be collected in a cup through the opening of the container.

5 Claims, 9 Drawing Sheets

DISPENSING VALVE/COUPLING ASSEMBLY

This is a continuation of application Ser. No. 07/604,165 filed Oct. 29, 1990, now abandoned.

BACKGROUND OF THE INVENTION

1. Field of the Invention

The present invention relates to a coupling suitable for the drinking fluid container and capable of picking up a necessary amount of fluid out of the flexible container while keeping the fluid sealed from outside.

2 Description of the Related Art

There has been already developed an automatic vending machine of the bag-in-box (or BIB) type wherein the flexible container (or pouch) made of flexible sheet or film and filled with drinking fluid such as coffee and fruit juice is transported in a box made of corrugated cardboard.

According to this automatic vending machine of the BIB type, its cost can be made low because the container is disposable, and it can be sanitary because fluid in the container can be sucked into a cup by a pump while keeping the fluid shielded from outside.

A coupling connected to the flexible container and then to the piping in the automatic vending machine to allow fluid in the container to be sucked into the cup under this shied state is disclosed by Japanese Patent Disclosure Sho 62-258288 and others.

The coupling disclosed in Japanese Patent Disclosure Sho 62-258288 comprises a female connector attached to the container and a male connector fitted into the female one. When the male connector is fitted into the female one, a hermetic seal bonded to the bottom of the female connector is broken by a tip formed at the front end of the male connector and the container is thus opened. When the male connector is further pushed into the female one, a valve body formed in an inner cylinder of the male connector is opened to communicate the container with a flow path in the male connector an when the male connector is pulled out of the female one, the valve body is closed to shied the inside in the piping, to which the male connector is connected, from outside and to prevent fluid remaining in the piping from flowing out of the male connector.

It is desirable in the case of the above-described coupling that fluid in the container can be shielded from outside every time only an amount of fluid needed is collected from the container into the cup.

In the case of the coupling disclosed in Japanese Patent Disclosure Sho 62-258288, however, the container is usually communicated with the piping through the male and the female connector until the male connector is detached from the female one after the former is connected to the latter. This makes it impossible to shield fluid in the container from outside. Fluid is thus allowed to return from the piping back into the container or bacteria are allowed to enter into the container, so that fluid in the container cannot be kept pure. Further, even when the sucking pump is stopped, fluid remaining in the piping is allowed to drop for a while because the container and the piping are left communicated with each other.

Still further, it happens sometimes that the hermetic seal cannot be broken because of its thickness.

SUMMARY OF THE INVENTION

The object of the present invention is therefore to provide a coupling capable of sealing fluid in the container from outside when the coupling is not connected to the container, preventing fluid from dropping after the sucking of fluid is stopped, and reliably breaking the hermetic seal.

This object of the present invention can be achieved by the following coupling. This coupling is freely detachably attached to the flexible container whose opening or outlet is closed by a seal member broken by the tip of a matter. The coupling comprises cylindrical body provided with a fluid sucking hole at the tip thereof, a valve seat formed in the cylindrical body, a valve body arranged in a fluid flowing path communicated with the fluid sucking hole, and a spring for urging the valve body against the valve seat. When a sucking pump is made operative to suck fluid in the container, the valve body is drawn against the spring to communicate the fluid flowing path with the sucking hole.

In the case of the coupling having the above-described arrangement, the valve body in the cylindrical body is opened when sucking pressure is applied from the sucking pump to the fluid flowing path and it is closed when the supply of sucking pressure is stopped. The sucking pressure is applied from the sucking pump to the fluid flowing path only when a necessary amount of fluid such as fruit juice in the container is to be sucked and collected into a cup. When fluid in the container is under waiting state not to be sucked and collected only by the necessary amount of it into the cup, therefore, fluid in the container can be reliably shielded from outside.

Further, the dropping of fluid can be prevented because the valve body is closed when the supply of sucking pressure is stopped.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Some embodiments of the present invention will be described in detail with reference to the accompanying drawings.

Figure 5:
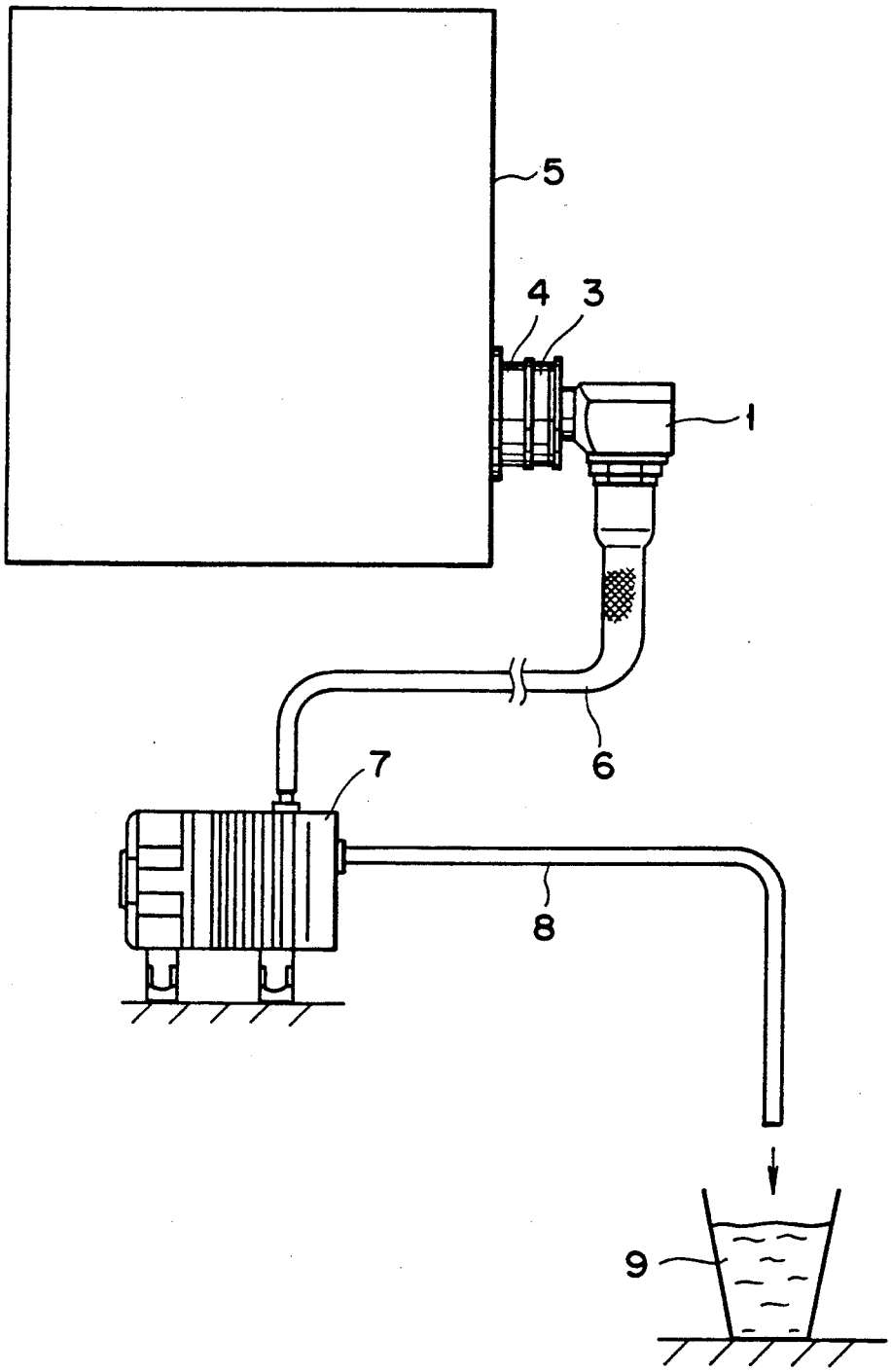
FIG. 5 shows the whole arrangement of a fluid feeder means of the automatic vending machine.

The whole arrangement of a fluid feeder or supply system of the automatic vending machine or the like shown in FIG. 5 will be described at first. A cylindrical spout 4 is fixed to the pouring outlet of a flexible container 5 and a female connector 3 which serves as an intermediate tap is fitted into the spout 4. The flexible container 5 is transported and housed in the container housing section of the automatic vending machine, while keeping the female connector 3 fitted into the spout 4.

A male connector 1 is inserted and fitted into the female connector 3 of the container 5 which is in the container housing section. One end of the male connector 1 is connected to a sucking pump 7 through a transparent tube 6, and another transparent tube 8 extends above a cup 9 from the discharging outlet of the sucking pump 7.

Because the container is transported with the female connector 3 fitted into the spout 4, a hermetic seal or seal member 10 is bonded to the bottom of the female connector 3 to seal fluid in the container 5.

Figure 3:
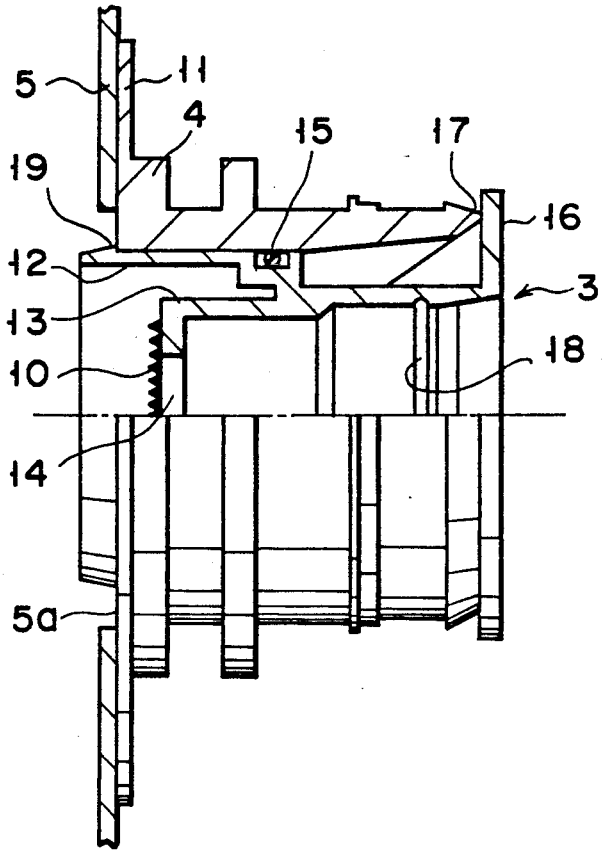
FIG. 3 is a partially-sectioned view showing a female connector and a spout.

As apparent from the vertically-sectioned view in FIG. 3 which shows the female connector 3 and the spout 4, the cross section of the spout 4 is cylindrical and one open end of the spout 4 is provided with a collar 11 extending outward in the radial direction thereof. That rim portion of the container 5 which forms the pouring outlet 5*a* is fixed to the collar 11 of the spout 4.

The cross section of the female connector 3 is cylindrical and that portion of the female connector 3 which is adjacent to the container 5 is of double-cylinder structure. More specifically, the female connector 3 is fitted into the spout 4 not to come out of the spout 4 in such a way that an outer cylindrical portion 12 of the female connector 3 is pressed against the inner face of the spout 4 due to the elasticity of the cylindrical portion 12 directing outward in the radial direction thereof and that a stepped portion 19 on the outer circumference of that part of the outer cylindrical portion 12 which is adjacent to the pouring outlet of the container 5 is engaged with that rim portion of the spout 4 which faces the pouring outlet of the container 5. Further, an 0-ring 15 is fitted onto the outer circumference of that part of the outer cylindrical portion 12 which is located on the side of the male connector 1, thereby preventing fluid from leaking between the outer circumference of the cylindrical portion 12 and the inner circumference of the spout 4. On the other hand, the bottom of an inner cylindrical portion 12 of the female connector 3 is provided with a fluid passing opening 14 which has a predetermined diameter and to which the hermetic seal 10 is bonded. Further, the other open end of the female connector 3 is provided with another collar 16 and when the underside of this collar 16 is struck against an open rim portion 17 of the spout 4, the female connector 3 is defined not to shift into the container 5. A recess 18 which serves to position the male connector 1 in the female connector 3 is formed on the inner face of an inner cylindrical portion of the female connector 3.

Figure 1:
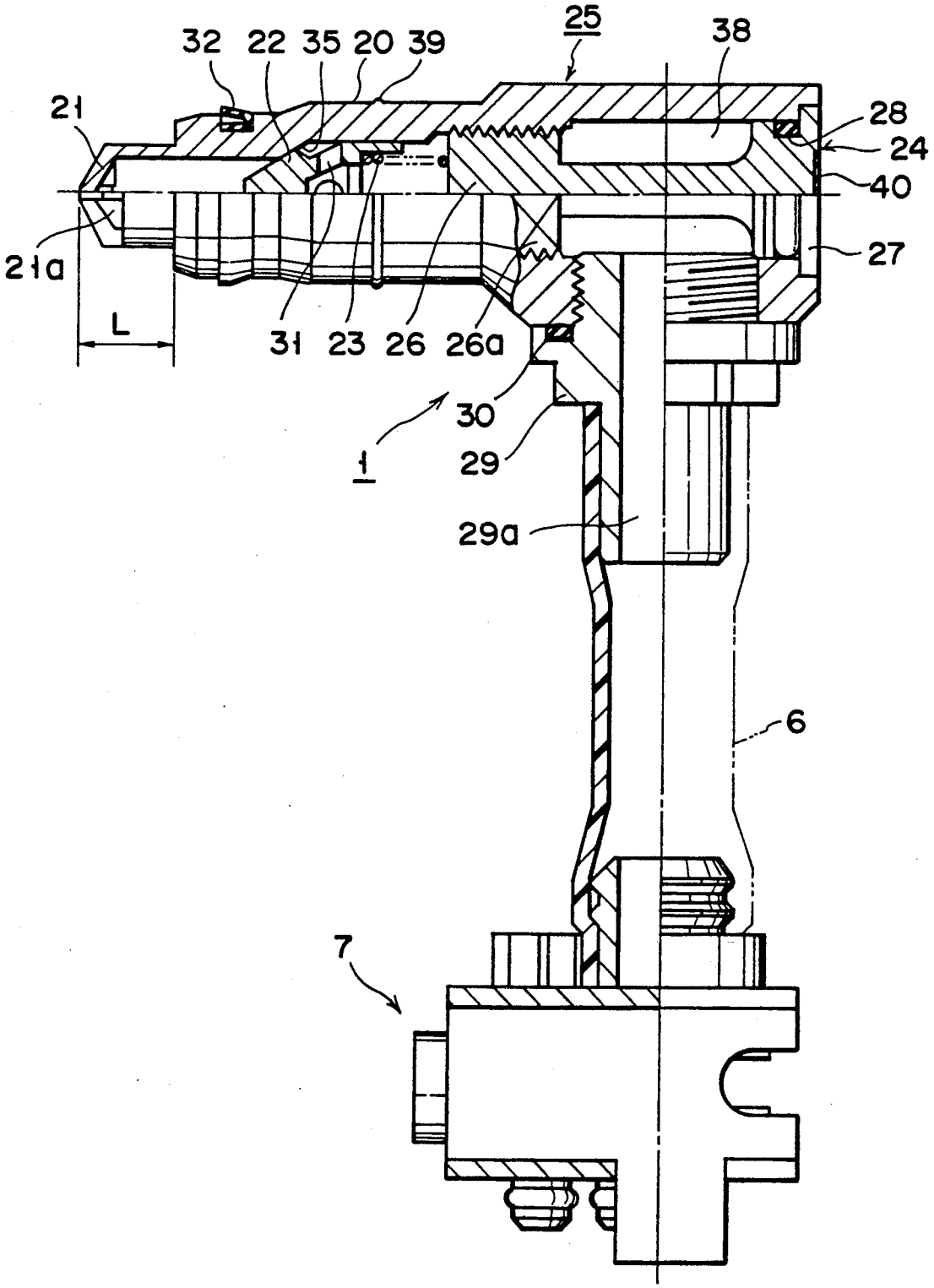
FIG. 1 is a partially-sectioned view showing a first example of the male connector according to the present invention.
Figure 2:
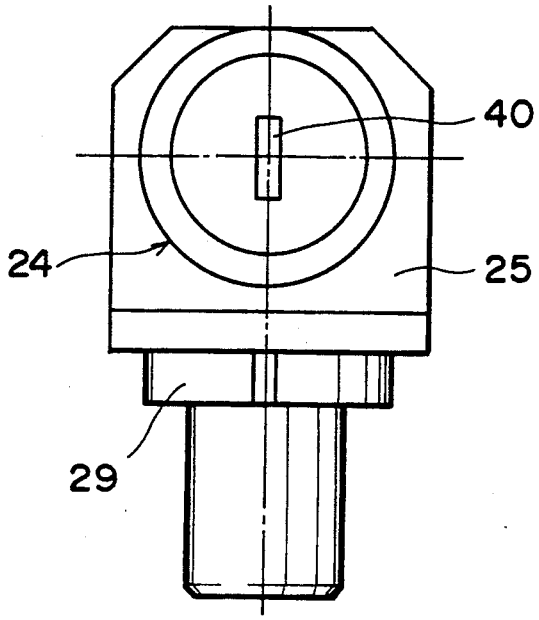
FIG. 2 is a right side view showing the male connector in FIG. 1.

The male connector 1 shown in FIG. 1 will be now described. The male connector 1 has an outer circumference 20 which can be fitted into the inner circumference of the inner cylindrical portion 13 of the female connector 3. The male connector 1 also has a cylindrical body 25 at the front end thereof and the cylindrical body 25 has a tip 21 to break the hermetic seal 10 bonded to the bottom of the female connector 3. A sucking hole 21*a* is formed in the tip 21 of the cylindrical body 25. A valve body 22 held movable in the axial direction of the cylindrical body 25 and a spring 23 for urging the valve body 22 toward the tip 21 of the body 25 are housed in the hollow of the cylindrical body 25. Further, a cap 24 is inserted and screwed from outside or opposite to the tip 21 into the cylindrical body 25. A fluid path 38 communicated with the sucking hole 21*a* of the tip 21 is formed on the outer circumference of the cap 24 and a front end 26 of the cap 24 is screwed into the hollow at the intermediate portion of the cylindrical body 25. The front end 26 of the cap 24 serves as the seat of the spring 26 which urges the valve body 22 toward the tip 21 and against a seat 35. A head 27 of the cap 24 is embedded in a recess on the rear open end of the cylindrical body 25 to cooperate with an O-ring 28 to hermetically seal the rear open end of the cylindrical body 25. As shown in FIG. 2, the head 27 of the cap 24 is provided with a groove 40 into which the tip of a tool is fitted to screw the front end 26 of the cap 24 into the hollow of the cylindrical body 25.

A cylindrical hose nipple 29 is screwed into the underside of the cylindrical body 25 to communicate with the fluid path 38 of the cap 24 and the transparent tube 6 is attached to the other end of the hose nipple 29. An O-ring 30 is fitted onto that portion of the hose nipple 29 which is screwed into the cylindrical body 25 so as to prevent the leakage of fluid.

The front end of the valve body 22 is shaped conical and directed toward the tip 21 of the cylindrical body 25. When the male connector 1 is not connected to the female connector 3, the front end of the valve body 22 is urged to the tip 21 by the spring 23 to close the fluid passage in the cylindrical body 25.

The spring 23 has a spring constant smaller than the sucking pressure of the pump 7. When this sucking pressure is applied from the pump 7 to the valve body 22 through the transparent tube 6 and the path 38 on the cap 24, the valve body 22 is caused to open the fluid passage in the cylindrical body 25. The valve body 22 is provided with a hole 31 which allows fluid sucked through the tip 21 when the fluid passage in the cylindrical body 25 is opened to pass therethrough.

Figure 4:
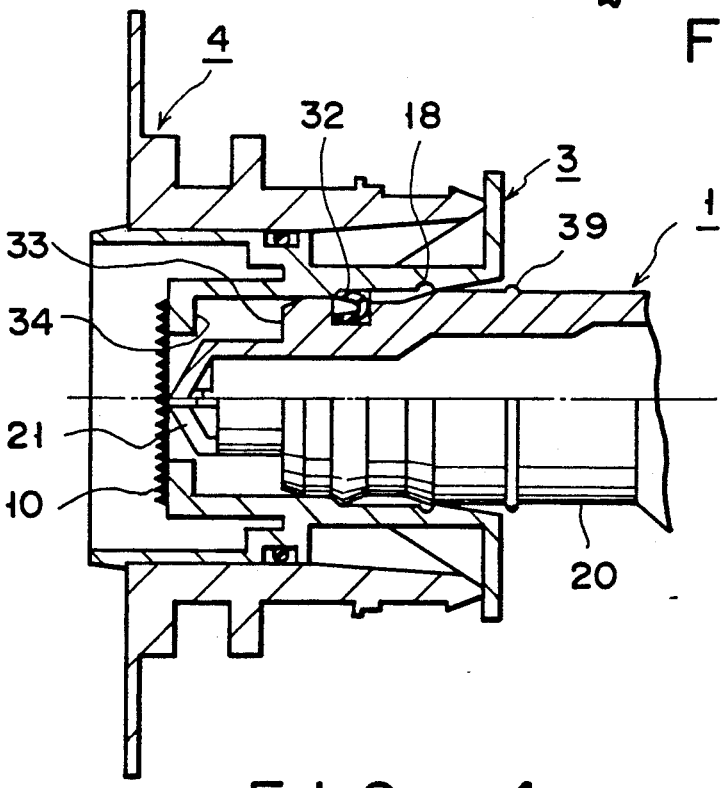
FIG. 4 is a partially-sectioned view showing the main portions of the male and the female connector wherein the front end of the male connector is fitted into the female connector.

As shown in FIG. 4, the front end of the male connector 1 is fitted into the inner cylindrical portion of the female connector 3 and a Y-shaped packing 32 is fitted onto the the front end of the male connector 1 to prevent the leakage of fluid when the male connector 1 is fitted into the female one 3 in this manner. Further, a protrusion 39 is formed on an outer circumference 20 of the male connector 1 to fit into a recess 18 on the inner face of the inner cylindrical portion 13 of the female connector 3.

The tip 21 of the cylindrical body 25 has a length L so long enough in the axial direction thereof as to prevent it from being closed by the hermetic seal 10 sucked by the sucking pressure of the pump 7 when the seal 10 is broken by it.

The operation of the above-described embodiment will be described.

Figure 6:
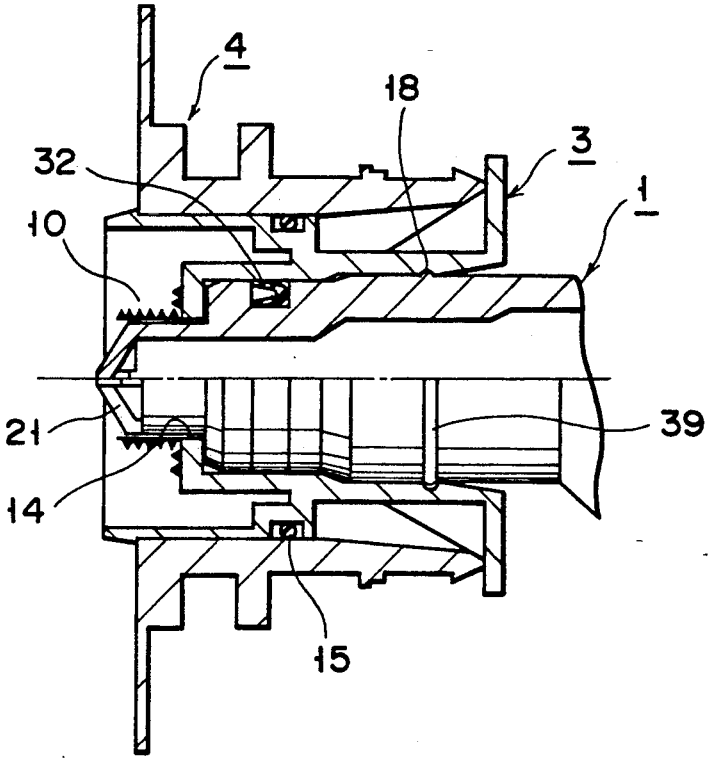
FIG. 6 is a partially-sectioned view showing the main portions of the male and the female connector wherein the hermetic seal is broken by the tip of the the male connector.

When the male connector 1 is disconnected from the female one 3, their movable parts are under such condition as shown in FIGS. 1 and 3. When the male connector 1 is inserted, as shown in FIG. 4, into the female connector 3 under this state until the former's front stepped portion 33 is struck against a flange 34 of the inner cylindrical portion 13 of the latter, the hermetic seal 10 begins to be broken by the tip 21 of the cylindrical body 25 of the former and when the length of the male connector 1 inserted into the female one 3 reaches the valve of L, the hermetic seal 10 is broken to an opening whose size is same in diameter as a fluid passing unite 14 of the female connector 3, as shown in FIG. 6. At the same time, the protrusion 39 on the outer circumference of the male connector 1 is fitted into the recess 18 on the inner face of the inner cylindrical portion 13 of the female connector 3 and the male connector 1 is thus fitted into the female one 3. Y-shaped packing 32 serves this time to hermetically seal between the inner face of the inner cylindrical portion 13 of the female connector 3 and the outer circumference of the male connector 1.

When the pump 7 is made operative to pick up a necessary amount of fluid from the container 5 into the cup 9 and sucking pressure is applied to the fluid path 38 on the cap 24 through the transparent tube 6 and the hose nipple 29, the sucking pressure overcomes the elasticity of the spring 23 and the valve body 22 is drawn toward the side of the cap 24. The valve body 22 is thus cause to open the fluid passage in the male connector 1. Fluid in the container 5 is there-fore sucked into the transparent tube 6, passing through the broken hermetic seal 10, a space outside the outer circumference of the valve body 22, a hole 31, a cut-away portion 26*a* of the front end 26 of the cap 24, the path 38 and a hollow 29*a* of the hose nipple 29, and then into the cup 9, passing through the pump 7 and the transparent tube 8.

When the pump 7 s stopped just after the necessary amount of fluid is fed into the cup 9, the elasticity of the spring 23 becomes larger than the sucking pressure of the pump 7 and the valve body 22 is thus urged toward the side of the tip 21 to close the fluid passage in the male connector 1. Even if the hermetic seal 10 is broken, therefore, fluid in the container 5 can be kept sealed from outside by the valve body 22. When fluid in the container 5 is sealed from outside in this manner, bacteria can be reliably prevented from entering from the transparent tube 6 into the container 5 and fluid reliably in the transparent tube 6 can also be reliably prevented from flowing back into the container 5 to reduce the purity of fluid in the container 5.

Further, the valve body 22 closes the fluid passage in the male connector 1 at the same time when the supply of sucking pressure is stopped. This prevents fluid from continuing to drop into the cup 9. Still further, no fluid is caused to remain in the transparent tubes 6 and 8. This can decelerate the speed at which these tubes 6 and 8 are made unclean.

Figure 7:
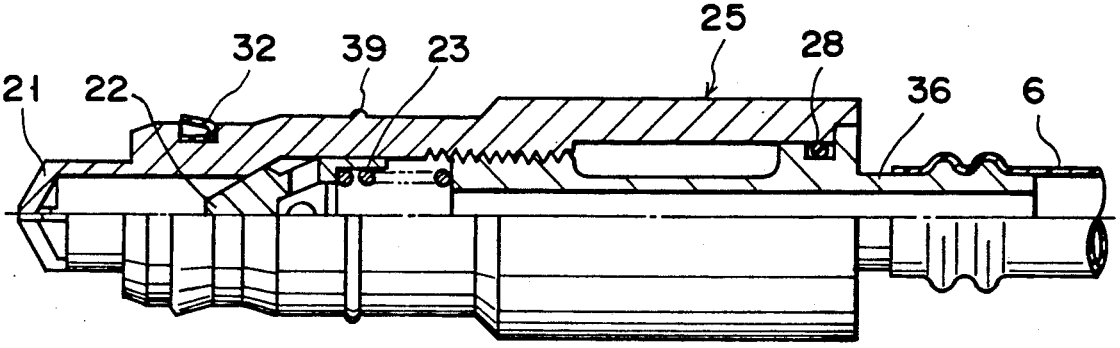
FIG. 7. is a partially-sectioned view showing a second example of the male connector according to the present invention.

The male connector 1 shown in FIG. 1 is shaped like an L, attaching the hose nipple 29 to the cylindrical body 25 at the right angle, but as apparent from a second embodiment of the present invention shown in FIG. 7, it may be arranged that the cap screwed into the cylindrical body 25 is formed as a hollow cap 36 and that the transparent tube 6 is connected to an open end of the cap 36. Fluid is introduced into the transparent tube 6 through the hollow of the cap 36 in this case. Same components as those in FIG. 1 are represented by same reference numerals in FIG. 7.

A third embodiment of the present invention will be described.

Figure 8:
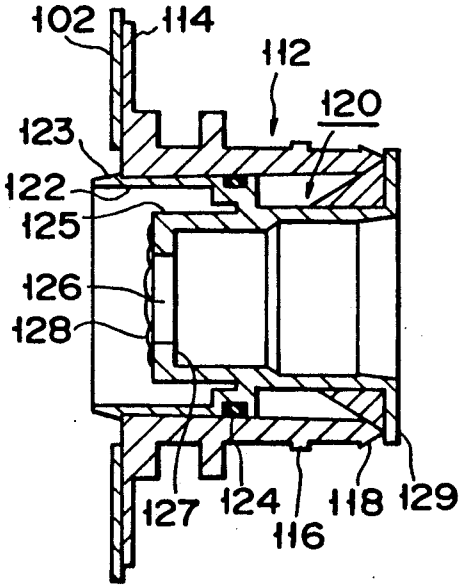
FIG. 8 is a vertically-sectioned view showing a female connector and a spout cooperated with a third example of the male connector according to the present invention.
Figure 10:
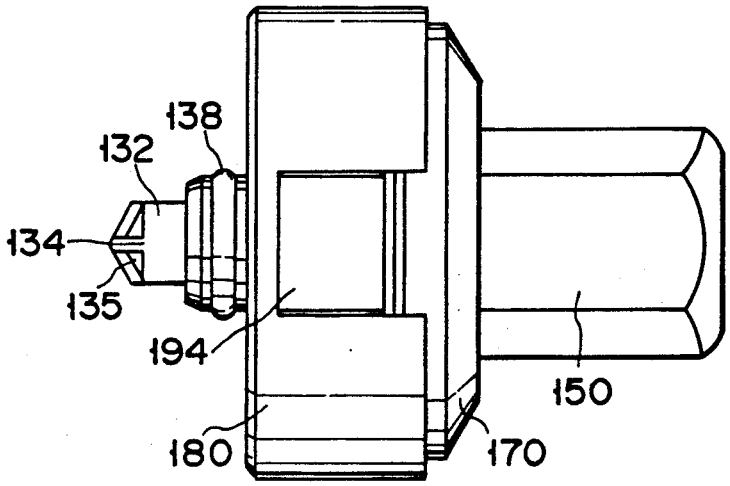
FIG. 10 is a plan showing the male connector in FIG. 9.

A female connector 120 is connected into a spout 112 in FIG. 8. The open base of the spout 112 is provided with a collar 114 which is air-tightly fixed to the pouring outlet of a container 102.

In the case of this example, a protrusion ring 116 is formed on that portion of the outer circumference of the spout 112 which is on the side opposite to the pouring outlet of the container.

That half of the female connector 120 which is on the side of the container is of double-cylinder structure and an outer cylindrical portion 122 is pressed against the inner face of the spout 112 due to the elasticity of the cylindrical portion 122 itself. When a step 123 on that open end of the outer circumference of the cylindrical portion 122 which is on the side of the pouring outlet of the container is engaged with the rim of the open base of the spout 112, the female connector 120 can be kept not to come out of the spout 120. An O-ring 124 is fitted onto the cylindrical portion 122 to establish sealing between the female connector 120 and the spout 112.

The bottom of an inner cylindrical portion 125 is provided with an opening 126 which has a predetermined diameter and which is closed by a seal member 128 relatively easily opened by a sharp tip.

The other open end of the female connector 120 is provided with a collar 129, which covers a rim 118 of the open end of the spout 112 and stops the female connector 120 from falling into the spout 112.

Figure 9:
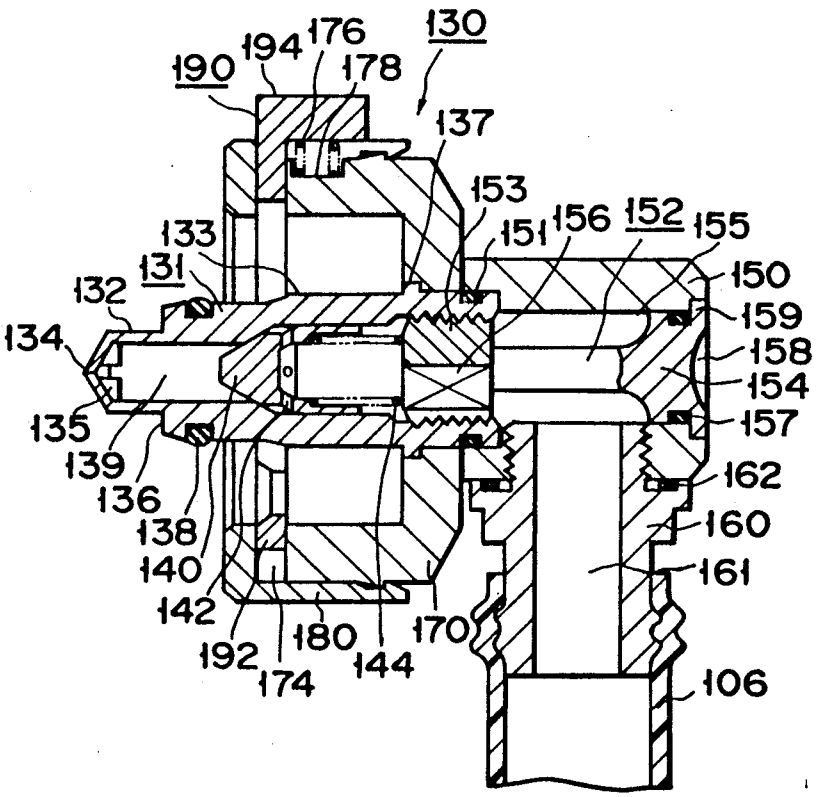
FIG. 9 is a vertically-sectioned view showing the third example of the male connector.

In FIG. 9, the front portion of a male connector 130 comprises a main cylindrical body 131 having an outer circumference 133 engaged with the inner cylindrical face of the female connector 120, a cross-shaped tip 134 at the front end thereof to break the seal member 128, and a cylindrical portion 132 of small diameter provided with fluid passing holes 135; a valve body 140 urged toward the tip 134 of the main cylindrical body 131 by a compression coil spring 144 and held movable in the axial direction in a fluid flow path 139 of the main cylindrical body 131; a sleeve 170 held freely rotatably on the outer circumference of the main cylindrical body 131 and fitted onto the spout 112 when the male connector 130 is connected to the female one 120; and a lock ring 190 held in a clearance 174 between the sleeve 170 and a cover 180 freely detachably capped on the front of the sleeve 170 so as to slide in a direction perpendicular to the axial direction of the main cylindrical body 131.

On the other hand, the rear portion of the male connector 130 comprises a rear cylindrical body 150 fitted onto the rear end of the main cylindrical body 131 and provided with an adapter 160 which is screwed into the outer circumference of the body 150 at right angle; and a cap 152 having a front portion 153 provided with chamfered parallel faces 156 thereon to allow the flow of fluid, screwed into the rear end portion of the main cylindrical body 131, and provided with a collar 159 at a head 154 to press the rear cylindrical body 150 from backside and an O-ring 157 to establish sealing between the rear cylindrical body 150 and the cap 152.

Figure 11:
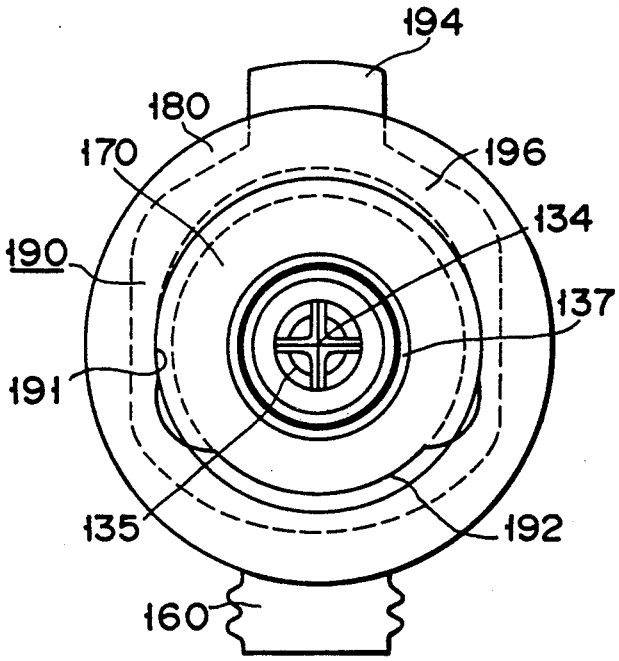
FIG. 11 is a front view showing the male connector in FIG. 9.

Further, an O-ring 138 is fitted onto the front outer circumference of the main cylindrical body 131 to seal the inner circumference of the female connector 120 when the male connector 130 is connected to the female one 120. Still further, a protrusion ring 137 on the rear outer circumference of the main cylindrical body 131 serves to stop the sleeve 170 freely rotatable. The protrusion ring 137 is shaped like a circle as shown in FIG. 11, but it may be shaped polygonal to stabilize the attaching angle of the sleeve 170 relative to the main cylindrical body 131. That inner circumference of the sleeve 170 which is contacted with the polygonal protrusion ring 137 is also shaped polygonal in this case.

The front end of the valve body 140 fitted into the main cylindrical body 131 is shaped like a top-chipped cone, directing in the direction of the tip 134, and it is urged toward the tip 134 by the compression coil spring 144 to close the fluid passing path 139 in the main cylindrical body 131. Reference numeral 142 represents a fluid hole passing through the valve body 140 from the outer circumference thereof in the diameter direction thereof and allowing fluid, which is sucked through the fluid passing holes 135 at the cross-shaped tip 134 when the valve body 140 opens the path 139 in the main cylindrical body 131, to pass therethrough.

The spring constant of the compression coil spring 144 which urges the valve body 140 is set such a value that causes the valve body 140 to move a distance needed to pick up fluid in the container 102 when the pump (not shown) is made operative. When the pump is made operative, therefore, the valve body 140 is moved the predetermined distance to open the fluid passing path 139 and when the pump is stopped, the path 139 is completely closed but the compression coil spring 144 may not be so strong.

The diameter of an inner circumference 191 of the lock ring 190 is a little larger than the outer diameter of the spout 112 and as shown in FIG. 11, a semi-circual projection 192 is projected from the inner circumference of that end of the lock ring 190 which is directed in its sliding direction so as to be engaged with the protrusion ring 116 on the outer circumference of the spout 112. The lock ring 190 also has a pressing section 194 on the outer circumference of its free end at a position opposite to the projection 192. That face of the projection 192 which is contacted with the outer circumference of the spout 112 is chamfered, which makes the movement of the male connector smooth when it is connected to the female connector. That face of the projection 192 which is engaged with the protrusion ring 116 is made flat and perpendicular to the axial center line of the main cylindrical body 131 not to separate the male connector from the female one because of slight force added after the male connector is connected to the female one.

A compression coil spring 176 is arranged between the pressing section 194 of the lock ring 190 and the sleeve 170 with its lower half embedded in a circular hole 178 on the outer circumference of the sleeve 170. The lock ring 190 is urged upward in FIG. 9 by the compression coil spring 176, contacting its shoulder 196 with the inner circumference of the cover 180 while engaging its projection 192 with the protrusion ring 116 of the spout 112. When the lock ring 190 is pushed against the compression coil spring 176, the projection 192 is plunged into the sleeve 170, thereby releasing the spout 112 from its engaged state.

The end face of the front end 153 of the cap 152 serves as a seat for the compression coil spring 144, which urges the valve body 140 toward the tip 134 of the formed on the outer circumference of the cap 152 except on that of the head 154. The head 154 of the cap 152 is provided with a groove 158 into which the tip of a tool is fitted when the front portion 153 of the cap 152 is screwed into the main cylindrical body 131.

The adapter 160 having having a fluid flow path 161 therein is screwed onto the rear cylindrical body 150 through an O-ring 162 and the path 155 is communicated with the pump through the tube 106 connected to the adapter 160.

It will be now described how the third embodiment of the present invention operates.

Figure 12:
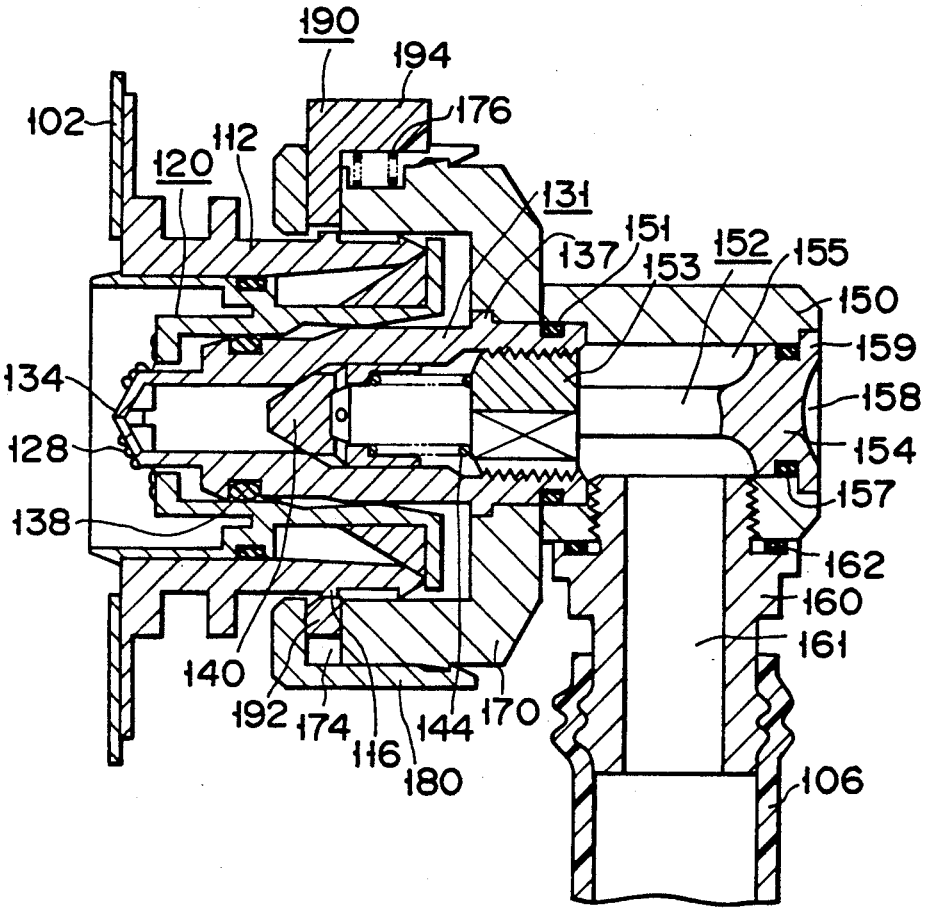
FIG. 12 is a vertically-sectioned view showing such state of the male connector that is about to finish its fitting into the female connector and the spout.

In order to connect the male connector 130 to the spout 112 and the female connector 120, the front end of the main cylindrical body 131 of the male connector 130 is inserted at first into the female connector 120. When the tip and smaller-diameter cylindrical portion 134 and 132 are pushed into the opening 126 of the female connector 120. The seal member 128 which seals the opening 126 is broken by the tip 134. The sleeve 170 encloses the outer circumference of the spout 112 this time, while striking the projection 192 of the lock ring 190 against the protrusion ring 116 on the spout 112. The front face of the projection 192 is chamfered as described above. As the male connector 130 is inserted into the female connector 120, therefore, the protrusion ring 116 pushes the projection 192 as shown in FIG. 12 and the lock ring 190 moves to projection the projection 192 into the sleeve 170 against the compression coil spring 176.

Figure 13:
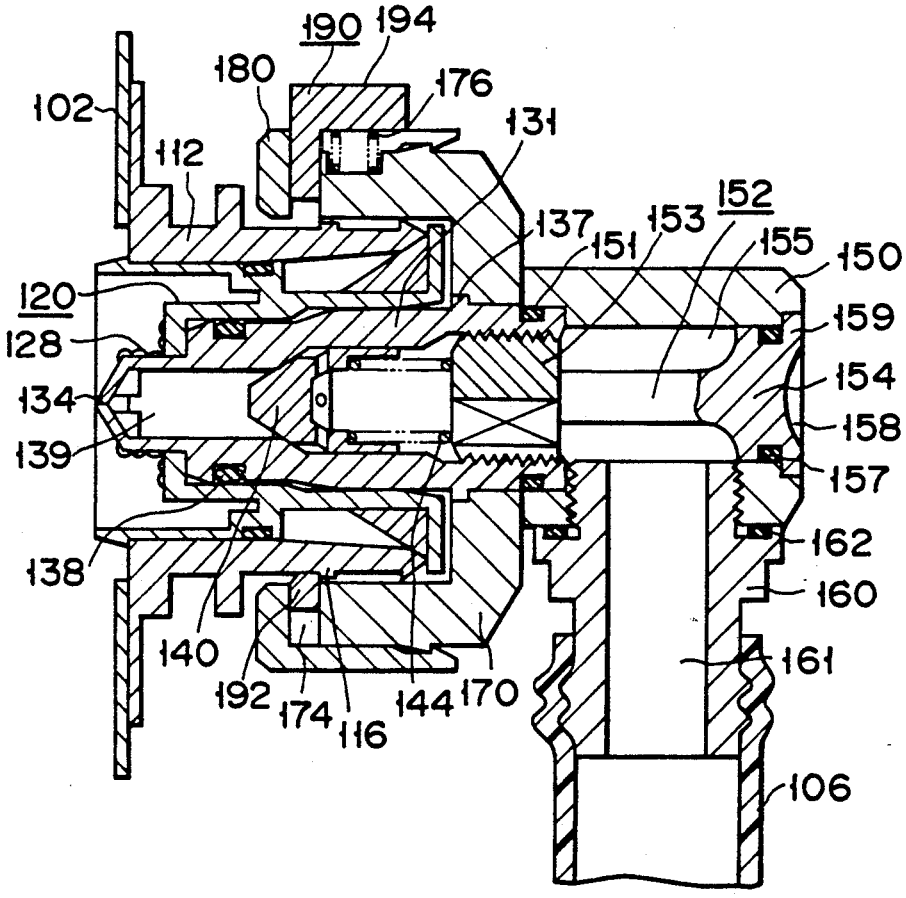
FIG. 13 is a vertically-sectioned view showing such state of the male connector which has been fitted into the female connector and the spout.

When the main cylindrical body 131 is further inserted into the female connector 120, the projection 192 passes over the protrusion ring 116 and the lock ring 190 is returned to its original position by the compression coil spring 176 while the projection 192 is engaged with the backside of the protrusion ring 116, as shown in FIG. 13.

When the male connector is connected to the female connector and the spout in this manner, the front step 136 of the main cylindrical]body 131 is struck against the bottom 127 of the inner cylindrical portion 125 of the female connector 120 and sealing is established between the inner circumference of the female connector 120 and the outer circumference of the main cylindrical body 131 by the seal ring 138.

When the adapter 160 and the pressing section 194 of the sleeve 170 are not directed in desired directions after or upon the connection of the male connector to the female one, both or one of the sleeve 170 and the rear cylindrical body 150 are (or is) rotated round the main cylindrical body 131 to adjust these directions of the adapter 160 and the pressing section 194.

When fluid is to be picked up from the sealed container 102, the pump is made operative to apply sucking pressure to the fluid passing path 155 through the tube 106. The sucking pressure overcomes the elasticity of the compression coil spring 144 to suck the valve body 140 toward the cap 152. As the result, the fluid passing path 139 is communicated with the paths 155 and 161 and fluid in the container 102 is thus collected in the cup, passing through the holes 135 at the tip 134 of the main cylindrical body 131, the fluid passing path 139, the hole 142 in the valve body 140, the paths 155, 161 and the tube 106.

When the pump is stopped after the predetermined amount of fluid is collected in the cup, the elasticity of the compression coil spring 144 acts on the valve body 140 at once, causing the valve body 140 to close the fluid passing path 139. Fluid in the container 102 can be completely shielded from outside by the valve body 140 under this state.

When the male connector 130 is to be detached from the spout 112 and the female connector 120, the pressing section 194 is pushed against the compression coil spring 176 to release the projection 192 of the lock ring 190 from the protrusion ring 116 of the spout 112. The male connector 130 is then pulled out of the female connector 120.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A dispensing coupling for a container comprising a female connector having an opening closed by a seal, and adapted for detachable attachment to the container;

a male connector having a main cylindrical body portion and a rear cylindrical body portion, said main cylindrical body portion provided with a tip portion, said main cylindrical body portion and said tip portion adapted to be inserted into said opening to break said seal, said tip portion having a hole for sucking fluid from the container; p1 a valve seat formed in said main cylindrical body portion;

a valve body arranged in a fluid passing path in said rear cylindrical body portion and movable relative to said main cylindrical body portion and said tip portion, said valve body in fluid communication with said hole;

a spring for urging said valve body toward said opening and said valve seat to thereby maintain said valve body engaged with said valve seat upon insertion of said male connector into said female connector; and wherein when a sucking pump is made operative to suck fluid from the container, said valve body is drawn toward and against said spring to disengage the valve body from the valve seat and thereby communicate said fluid passing path with the container, said coupling further comprising a spout having a protrusion ring on its outer circumference, said spout serving to attach said female connector to the container;

a sleeve rotatably fitted onto the outer circumference of said main cylindrical body portion of said male connector;

a lock ring arranged perpendicular to the longitudinal direction of said male connector and provided with a projection on its inner face to engage with a side of the protrusion ring, so as to fix said sleeve to said spout and;

a compression coil spring for urging said lock ring in the diameter direction of the ring.

2. The coupling according to claim 1, further including a cap member removably secured in a rear end opening of said main cylindrical body portion and serving as a seat for one end of said spring.

3. The coupling according to claim 1, further comprising a hose nipple attached to a side wall of said main cylindrical body portion.

4. The coupling according to claim 2, wherein said cap member has a hose connecting section.

5. The coupling according to claim 1, further comprising a Y-shaped packing arranged on the outer circumference of said main cylindrical body portion.

* * * * *